United States Patent [19]

Takagi et al.

[11] Patent Number: 4,836,698

[45] Date of Patent: Jun. 6, 1989

[54] INVERTIBLE RIBBON CARTRIDGE

[75] Inventors: Kazuhiko Takagi, Nagoya; Yoshihito Nonomura, Gifu, both of Japan

[73] Assignee: Brother Kogyo Kabushiki Kaisha, Aichi, Japan

[21] Appl. No.: 94,378

[22] Filed: Sep. 8, 1987

[30] Foreign Application Priority Data

Sep. 8, 1986 [JP] Japan ..... 61-137575[U]

[51] Int. Cl.[4] ..... B41J 32/00

[52] U.S. Cl. ..... 400/208; 400/217; 400/229

[58] Field of Search ..... 400/194, 195, 196, 196.1, 400/207, 208, 208.1, 217, 249, 229

[56] References Cited

U.S. PATENT DOCUMENTS

| | | | |
|---|---|---|---|
| 2,902,136 | 9/1959 | Whippo | 400/229 X |
| 2,986,260 | 5/1961 | Whippo | 400/208 |
| 4,264,223 | 4/1981 | Bemis et al. | 400/208 |
| 4,265,552 | 5/1981 | Bemis et al. | 400/208 X |
| 4,359,288 | 11/1982 | Bullock | 400/208 |
| 4,496,255 | 1/1985 | Meintrup et al. | 400/208 |
| 4,533,266 | 8/1985 | Saito et al. | 400/208 |
| 4,544,291 | 10/1985 | Nagata et al. | 400/208 |
| 4,568,210 | 2/1986 | Privitera | 400/208 X |
| 4,685,817 | 8/1987 | Surti | 400/208 |

FOREIGN PATENT DOCUMENTS

| | | | |
|---|---|---|---|
| 0012879 | 7/1980 | European Pat. Off. | 400/208 |
| 0036308 | 9/1981 | European Pat. Off. | 400/208 |
| 0025490 | 3/1981 | Japan | 400/208 |
| 0047685 | 3/1982 | Japan | 400/249 |
| 0224383 | 12/1984 | Japan | 400/208 |
| 0018381 | 1/1985 | Japan | 400/208 |
| 0190379 | 9/1985 | Japan | 400/208 |
| 2091644 | 8/1982 | United Kingdom | 400/208 |

*Primary Examiner*—Ernest T. Wright, Jr.

*Attorney, Agent, or Firm*—Kane, Dalsimer, Sullivan, Kurucz, Levy, Eisele and Richard

[57] ABSTRACT

In a printing apparatus wherein a reversible ribbon cassette is detachably installed, provided are means for indicating which side of the ribbon cassette is the side facing upward and means for detecting whether the side of the ribbon cassette attempted to be reloaded after once removed is the side facing upward or not based upon the indicating means. Thereby, misloading with the not-on-use side of ribbon cassette turned up is prevented and accordingly possibilities of blurred printing caused by use of already used area of the ribbon and/or of waste of the ribbon with remaining non-used portion thereon can be avoided. Further, even if the ribbon cassette installed in the apparatus is a multi-use-type one, the possibility of the printing quality being uneven due to the difference in number of times of use in places on the ribbon can also be prevented.

6 Claims, 10 Drawing Sheets

FIG. 1
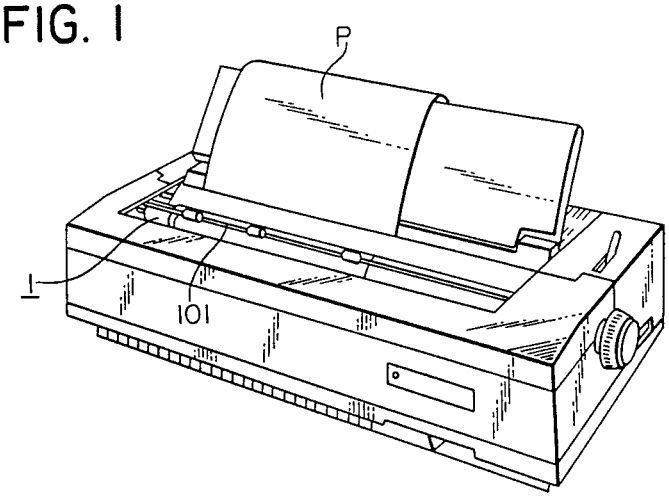
FIG. 2
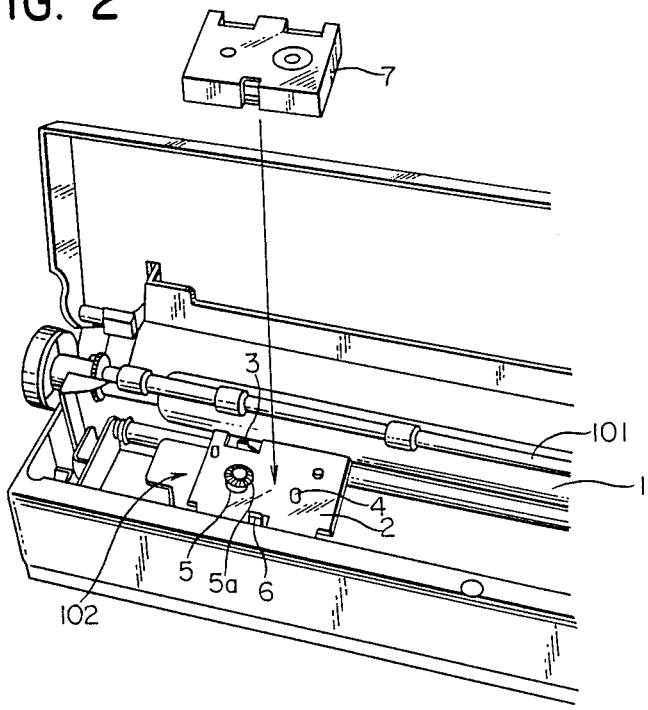
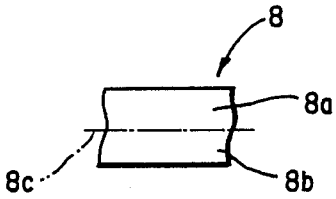
FIG. 2A

INVERTIBLE RIBBON CARTRIDGE,

BACKGROUND OF THE INVENTION

This invention relates to a printing apparatus such as a typewriter and a printer utilized as an output unit of a computer, and more particularly to a printing apparatus in which a ribbon cassette is loaded onto a carriage which is reciprocatively movable along a printing line on a printing paper.

Conventionally, there has been such a ribbon cassette as to be reversibly loaded onto the carriage. In other words, the surface of the ribbon contained in the cassette is horizontally separated into two areas and when the ribbon cassette is loaded on the carriage one side up, one of the areas on the ribbon surface is disposed along the printing line while, when it is loaded the other side up the other area is disposed along the printing line.

With the above reversible ribbon cassette, however, since there has been no means to indicate which side is now in use, if the ribbon cassette is unloaded from the carriage for some reason before the ribbon reaches to its one end, an operator very likely misloads the ribbon cassette by putting the reverse side up when resetting the cassette to the printing apparatus. This may cause a blurred printing by using the once used area of the ribbon or waste the ribbon cassette which has not yet completely been used.

Further, if the ribbon cassette to be installed is a multi-use type one, there is a possibility of the quality of printing being uneven if there is a difference in the number of times of use in places of the ribbon surface. This difference has been frequently caused by reloading the cassette with the reverse (not-on-use) side turned up by mistake after the cassette is once removed for some reason before the ribbon reaches to its one end.

SUMMARY OF THE INVENTION

It is therefore an object of this invention to provide an improved printing apparatus, wherein a reversible ribbon cassette is utilized, capable of recognizing which side of the ribbon cassette is in use even if the ribbon cassette is once removed from the apparatus and of ensuring to reload the ribbon cassette with the on-use side thereof turned up.

For this purpose, there is provided a printing apparatus wherein a reversible ribbon cassette is detachably installed, which comprises means for indicating a side of said ribbon cassette being in use and means for detecting whether the side of said ribbon cassette attempted to be reloaded after once removed is the side in use or not, based upon said indicating means.

With the above printing apparatus, when a ribbon cassette removed from the apparatus is to be reloaded, the loaded state of the cassette before the removal is detected by the detecting means based upon the indicating means and the reloading in the same state as that before the removal is ensured.

DESCRIPTION OF THE ACCOMPANYING DRAWINGS

FIGS. 1 and 2 show a thermal printer embodying the invention;

FIG. 2*a* is a fragmentary view of a length of ribbon depicting the two areas of the ribbon which may be used to print characters;

DESCRIPTION OF THE PREFERRED EMBODIMENT

Figure 3:
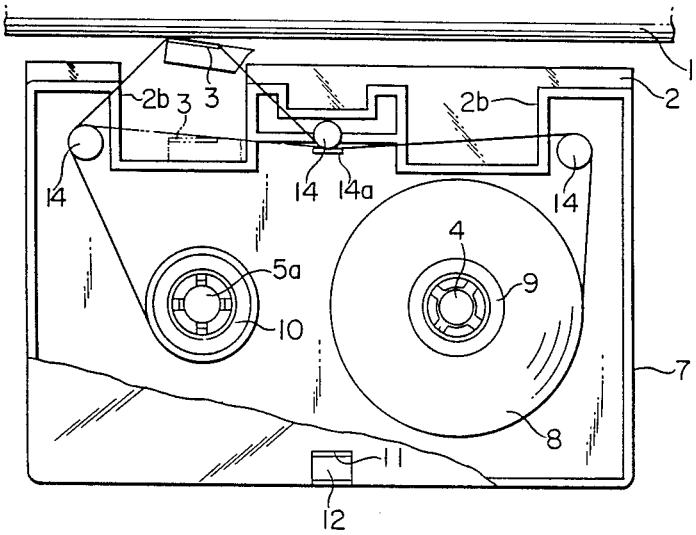
FIG. 3 is a fragmentary sectional plan view showing a loaded state of a ribbon cassette on a carriage.

FIGS. 1 and 2 show a thermal printer embodying the invention wherein a horizontally extending platen 1 and a pressing bar 101 are arranged in parallel for supporting and guiding a printing paper P. A printing head unit 102 is reciprocatively movably arranged along the axial direction of the platen 1. The printing head unit 102 comprises a carriage 2, a printing head 3 and a ribbon cassette 7.

On the carriage 2, as minutely illustrated in FIG. 3, the printing head 3 is supported movably between its printing position to abut against the platen 1 as illustrated by solid lines in FIG. 3 and a retracted position away from the platen 1 as illustrated by double-dotted lines in FIG. 3.

On the upper surface of the carriage 2, a fixed shaft 4 and a rotatable shaft 5 are mounted. The rotatable shaft 5 is provided with a spool engagement portion 5*a* on its top end and is rotated by a driving source, not shown, to take up a ribbon 8 installed in the ribbon cassette 7. At the center on the upper surface of the front portion of the carriage 2, a projection 6 is provided.

The ribbon cassette 7 to be loaded on the carriage 2 is a reversely loadable one. That is, within the ribbon cassette 7, pair of spools 9, 10 are rotatably disposed at symmetrical positions serving for both taking up and supplying the ribbon 8, and the surface of the ribbon 8 is seperated into two areas 8*a* and 8*b* along a feeding line 8*c* thereof. The ribbon 8 wound around the spool 9 on the supplying side is adapted to be taken up by the spool 10 on the take-up side around three ribbon guides 14. Close to the ribbon guide 14 located on the center of the ribbon cassette 7, a leaf spring 14*a* is provided for pressing the ribbon 8 against the ribbon guide 14. When the ribbon cassette 7 is loaded on the carriage 2, the spool 10 is engaged with the spool engagement portion 5*a* on the rotatable shaft 5 while the other spool 9 is loosely fitted on the fixed shaft 4. At the rear end portion of the ribbon cassette 7, a pair of recesses 2*b* are provided at symmetrical positions. The ribbon 8 is exposed within each of the recess 2b and the printing head 3 is adapted to be located inside the passage of the ribbon 8 within either one of the recesses 2b.

Figure 4:
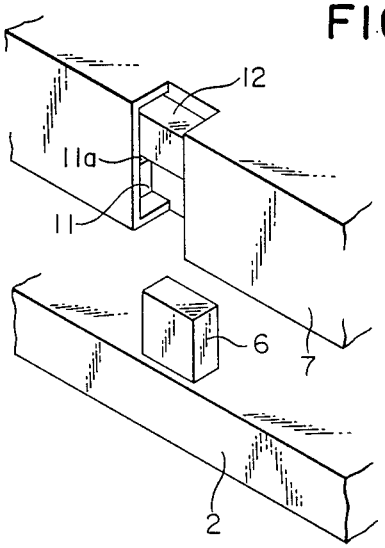
FIG. 4 is a partially enlarged front perspective view showing a blocking member on a ribbon cassette and a projection on a carriage.
Figure 5:
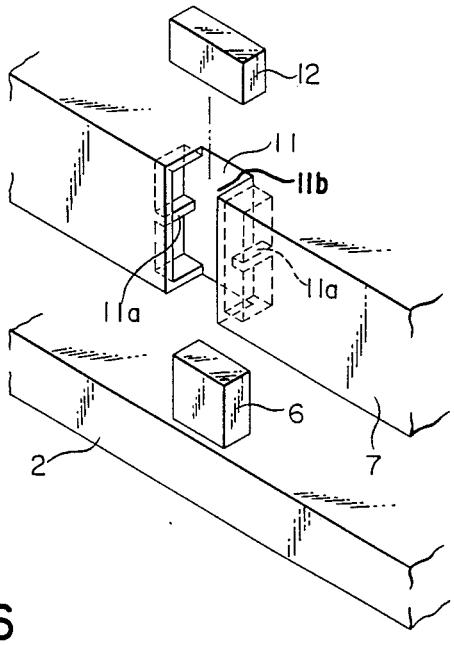
FIG. 5 is an exploded view of FIG. 4.
Figure 6:
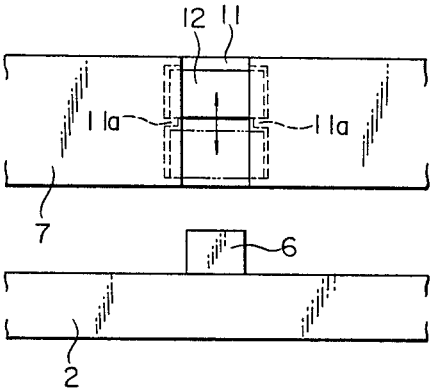
FIG. 6 is an explanatory front view of FIG. 4.

At the center of the front side surface of the ribbon cassette 7, a vertically extending recess 11 is formed. The recess 11 opens, as illustrated in FIGS. 4 through 6, for upside, downside and front side. The size of opening 11b of the recess 11 is formed to be smaller than the size of the interior thereof while slightly larger than that of the projection 6 to allow the same to pass therethrough. A the inner side surfaces of the recess 11, a pair of protrusions 11a are opposedly formed at the vertically intermediate position thereof. In the recess 11, a blocking piece 12 having a height aproximately half the height of the recess 11 and a width approximately the same as the width of the interior of the recess 11 is preliminaly accomodated. This blocking piece 12 is selectively accomodated in one of the inner spaces of the recess 11 divided by the above protrutions 11a and can be moved over the protrutions 11a as illustrated by solid lines and the double-dotted lines in FIG. 6.

In FIG. 4, the blocking piece 12 is disposed at the upper space of the recess 11 and therefore the projection 6 can be fitted in the lower space of the recess 11. That is, the ribbon cassette 7 can be loaded on the carriage 2. Then, the rotatable shaft 5 is rotated to rotate the spool 10 on the take-up side, whereby the ribbon 8 wound around the spool 9 on the supply side is taken up by the spool 10 on the take-up side around every ribbon guide 14 and the printing head 3, and the printing head 3 is operated, and thus, printing is made on the printing paper P placed on the platen 1 through cooperation of upper half on the ribbon 8, printing head 3 and the platen 1.

In order to remove the ribbon cassette 7 from the carriage 2, first, the printing head 3 is transferred to the retracted position illustrated by double-dotted lines in FIG. 3, and in this state, the ribbon cassette 7 is lifted up, whereby the two spools 9, 10 are slipped off of their respective shafts 4, 5 and, at the same time, the projection 6 becomes out of the recess 11. Thereafter, if the removed ribbon cassette 7 is reloaded onto the carriage 2 without being turned over, the projection 6 is again fitted into the recess 11, and thus, the reloading of the ribbon cassette 7 onto the carriage 2 is allowed. From the fact that the reloading is allowed as described above, it is certainly acknowledged that the loaded state of the ribbon cassette 7 is the same as that before the removal.

If it is attempted to reload the ribbon cassette 7 with the reverse side turned up by mistake, then the projection 6 on the carriage 2 comes in abutment with the blocking piece 12 within the recess 11 and thereby the projection 6 is prevented from entering into the recess 11. As a result, the reloading of the ribbon cassette 7 is prevented, and from the fact that the reloading is prevented, it is certainly acknowledged that it has been attempted to load the ribbon cassette 7 with the opposite side up which is different from that before the removal.

Now, in order to use another area of the ribbon 8 by loading the ribbon cassette 7 with the reverse side turned up, the blocking piece 12 is shifted against the resilience of the protrusions 11a into the lower space of the recess 11, and, after the blocking piece 12 has moved across the protrusions 11a and the protrusions 11a are restored to their original state, the blocking piece 12 is stably held at its lower position inside the recess 11 by the protrusions 11a and the peripheral portions of the opening 11b of the recess 11. Thus, the ribbon cassette 7 is allowed to be loaded with its reverse side turned up, and at the same time, it is prevented from being loaded with its original side turned up.

Figure 7:
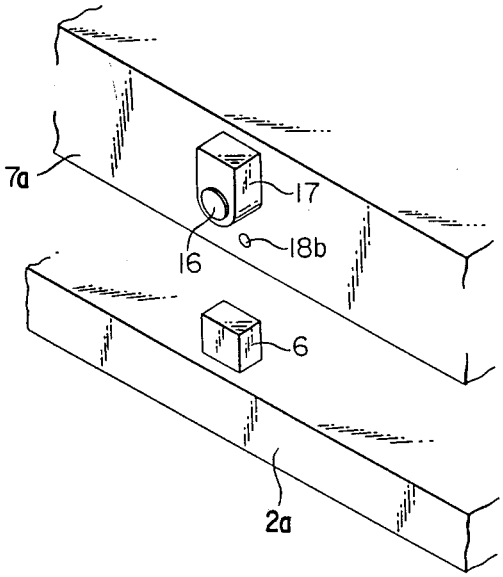
FIG. 7 is a partially enlarged front perspective view showing another blocking member provided in the ribbon cassette.
Figure 8:
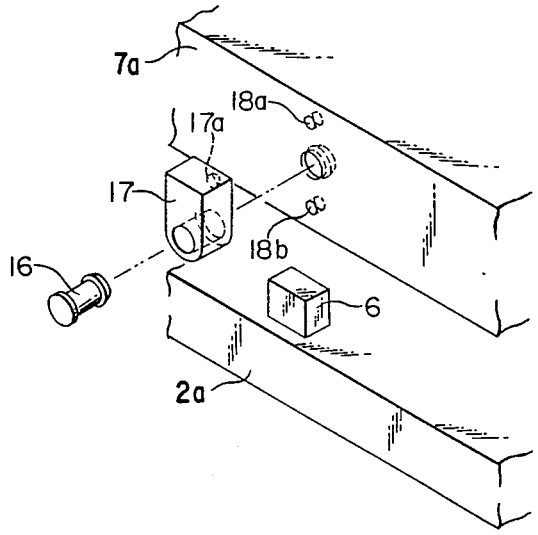
FIG. 8 is an exploded view of FIG. 7.
Figure 9:
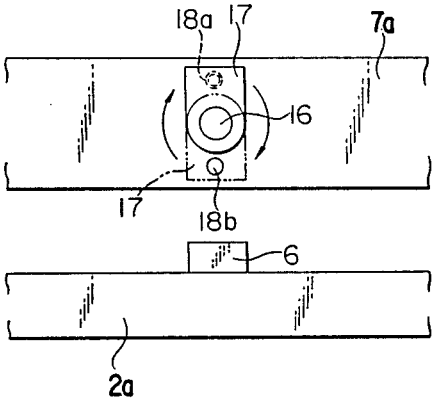
FIG. 9 is an explanatory front view of FIG. 7.

FIGS. 7 through 9 show a modified embodiment wherein the carriage 2a is extended beyond the front end of the ribbon cassette 7a, and the projection 6 is planted at the center on the extended portion. At the center on the front side surface of the ribbon cassette 7a, a blocking member 17 is rotatably supported by a shaft 16. A pair of hollows 18a, 18b are formed on the front side surface of the ribbon cassette 7a above and below the shaft 16, and a protrusion 17a enabled to be selectively engaged with either one of the hollows 18 a, 18b is formed on the blocking member 17. When the blocking member 17 is rotated and the protrusion 17a is engaged with the upper hollow 18a, the blocking member 17 is held at its first position illustrated by solid lines in FIG. 9, while if engaged with the lower hollow 18b, the same is held at its second position illustrated by double-dotted lines in FIG. 9. In the state as shown in FIG. 7, i.e., the blocking member 17 is held at its first position, there is a space below the blocking member 17 for disposing the projection 6 and thereby the ribbon cassette 7a can be loaded on the carriage 2a with the original side up.

When the ribbon cassette 7a loaded as above is once removed from the carriage 2a and then the ribbon cassette 7a is to be reloaded, if the same is loaded with the original side turned up, then the projection 6 does not interfere with the blocking member 17 and thereby the reloading of the ribbon cassette 7a is allowed. On the other hand, if the ribbon cassette 7a is reloaded with the reverse side turned up by mistake, then the projection 6 comes into contact with the blocking member 17 and thereby the reloading of the ribbon cassette 7a is prevented. The ribbon cassette 7a can be of course loaded if the blocking member 17 is manually rotated and held at its second position where the protrusion 17a engages the lower hollow 18b.

Figure 10:
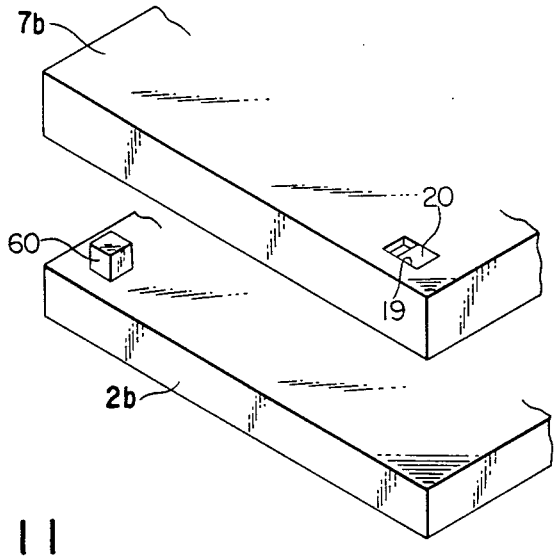
FIG. 10 is a partially enlarged front perspective view showing another blocking member on the ribbon cassette and corresponding projection on the carriage.
Figure 11:
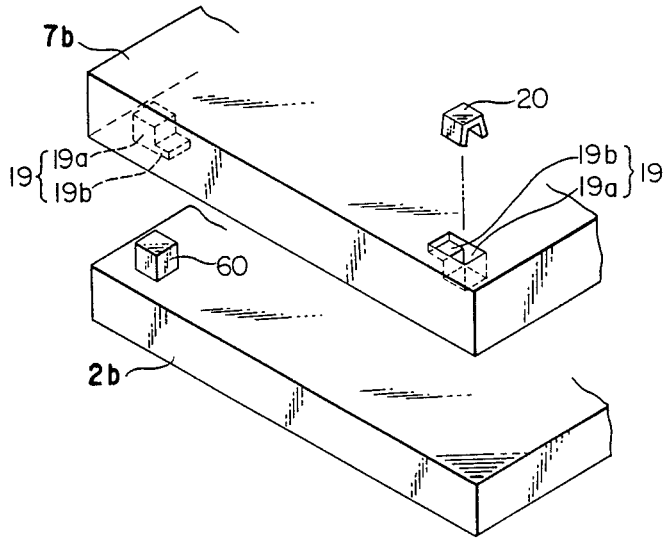
FIG. 11 is an exploded view of FIG. 10.

FIGS. 10 and 11 show a further modified embodiment wherein the carriage 2b is provided with a projection 60 disposed at the left-hand front end on the upper surface thereof. A pair of recesses 19 are symmetrically formed on the original and reverse side surface of the ribbon cassette 7a. Each recess 19 comprises a receiving portion 19a and a clawed portion 19 b. The receiving portion 19a is formed to receive the projection 60 therein and a blocking piece 20, respectively. The blocking piece 20 is formed of resilent material and has an inverted-U in cross section. In the state illustrated in FIG. 10, the projection 60 can be fitted in the vacant receiving portion 19a while the blocking piece 20 is fitted in other receiving portion 19a.

Accordingly, when the ribbon cassette 7b loaded as above is once removed from the carriage 2b and then the ribbon cassette 7b is to be reloaded, if the same is loaded with the original side turned up, then the projection 60 can be fitted into the receiving portion 19a formed of the reverse side of the ribbon cassette 7b and thereby the reloading of the ribbon cassette &b is allowed. On the other hand, if the ribbon cassette 7b is reloaded, by mistake, with the reverse side turned up, then the projection 60 is prevented from entering into the receiving portion 19a formed on the original side of the ribbon cassette 7b by the blocking piece 20 fitted therein so that the reloading of the ribbon cassette 7b is prevented. If the blocking piece 20 is lifted up and removed by inserting a finger tip into the clawed portion 19*b* and is then fitted into the receiving portion 19*a* on the reverse side surface of the ribbon cassette 7*b*, then reloading of the ribbon cassette 7*b* with the reverse side turned up is, of course, allowed while reloading with the original side turned up is then prevented.

Figure 12:
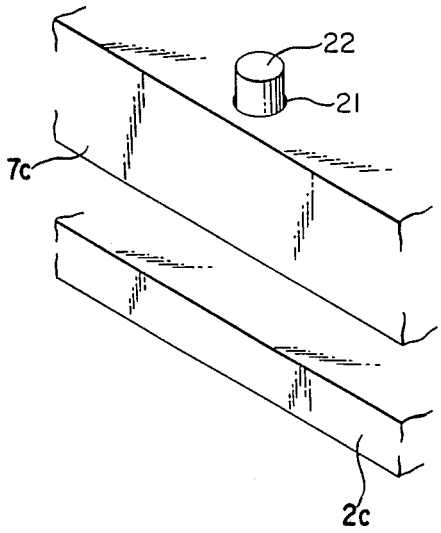
FIG. 12 is a partially enlarged front perspective view showing still another blocking member.
Figure 13:
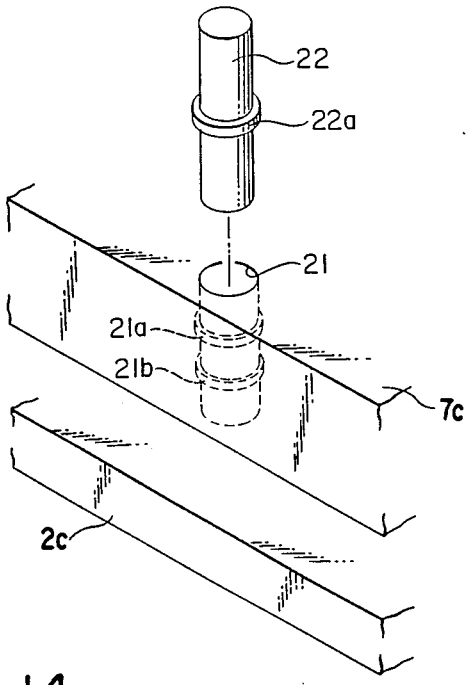
FIG. 13 is an exploded view of FIG. 12.
Figure 14:
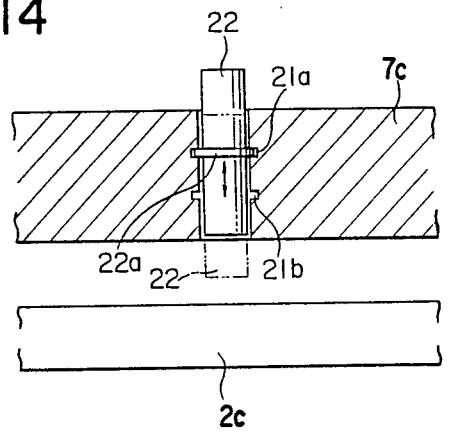
FIG. 14 is a partially sectional explanatory view of FIG. 12.

FIGS. 12 through 14 show a still further modification wherein a blocking rod 22 is vertically slidably received in a through-hole 21 provided at the center of the front portin of the ribbon cassette 7*c*. On the inner peripheral surface of the through-hole 21, formed are a pair of engaging grooves 21*a*, 21*b* at a predetermined vertical interval. On the other hand, an engaging flange 22*a* formed of a resilient material to be engaged with the engaging groove 21*a* or 21*b* is provided at the vertically intermediate position on the outer periphery of the blocking rod 22. That is, when the engaging flange 22*a* is engaged with the upper engaging groove 21*a*, the blocking rod 22 is held at its first position and one end thereof is projected out of the original side surface of the ribbon cassette 7*c* as illustrated by solid lines in FIG. 14. On the other hand, when the engaging flange 22*a* is engaged with the lower engaging groove 2*b*, the same is held at its second position where the other end of the blocking rod 22 is projected out of the reverse side surface of the ribbon cassette 7*c* as illustrated by double-dotted lines in FIG. 14.

Accordingly, when the ribbon cassette 7*c* loaded as above is once removed from the carriage 2*c* and then the ribbon cassette 7*c* is to be reloaded, if the same is going to be loaded with the reverse side turned up, the end portion of the blocking rod 22 projected out of the original side surface of the ribbon cassette 7*c* comes into abutment with the upper surface of the carriage 2*c* whereby the reloading of the ribbon cassette 7*c* is prevented. It is, of course, allowed to reload the ribbon cassette 7*c* with the reverse side turned up if the blocking rod 22 is pressed downwardly to put it into its second position illustrated in FIG. 14 by double-dotted lines where the flange 22*c* thereof is engaged with the lower groove 21*b*.

Figure 15:
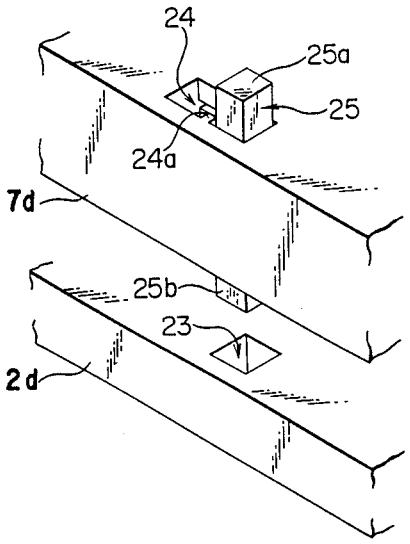
FIG. 15 is a partially enlarged front perspective view showing still another blocking member and a recess formed on the carriage.
Figure 16:
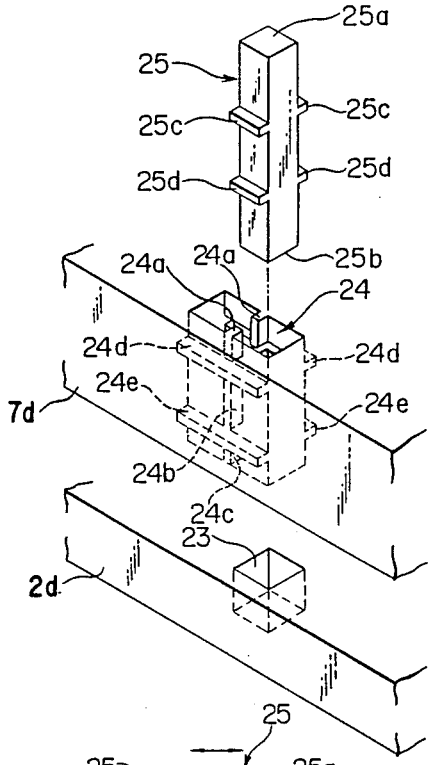
FIG. 16 is an exploded view of FIG. 15.
Figure 17:
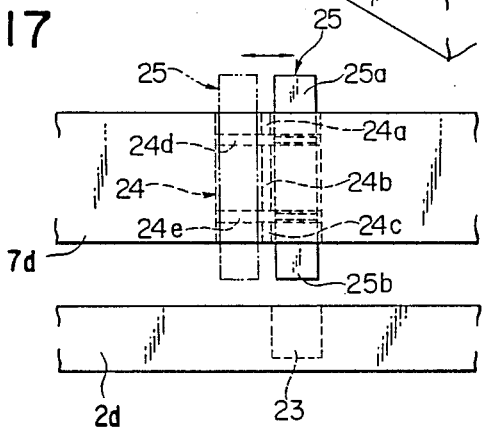
FIG. 17 is an explanatory front view of FIG. 15.

FIGS. 15 through 17 show still another modification wherein a recess 23 is formed on the upper surface of the front portion of the carriage 2*d* , which is put at slightly rightwardly shifted position from the center, while a blocking rod 25 is preliminarily held in a through-hole 24 formed in the front central portion of the ribbon cassette 7*d*. Inner space of the through-hole 24 is substantially seperated by opposedly protruded vertical ribs 24*a*, 24*b*, 24*c* made of a resilient material into two sections symmetrically formed about a line of the ribbon cassette 7*d*. The blocking rod 25 has an upper end 25*a* and lower end 25*b* protruding out of the original and reverse surfaces of the ribbon cassette 7*d*, respectively. On the other hand, the blocking rod 25 is provided with two pairs of opposedely protruding flange portions 25 i c, 25*d* at a predetermined vertical interval which are adapted to be engaged with guide grooves 24*d*, 24*e* formed on the inner wall of the ribbon cassette 7*d* to prevent the blocking rod 25 from slipping out of the through-hole 24. The blocking rod 25 has to be slid against resilience of the vertical ribs 24*a*–24*c* to be switched between two areas inside the through-hole 24 as illustrated by solid lines and double-dotted lines in FIG. 17. In the state as shown in FIG. 15, the blocking rod 25 is disposed at the right-hand section and the downwardly projected end 25*b* of the blocking rod 25 can be fitted in the recess 23 of the carriage 2*d*, whereby the ribbon cassette 7*d* is loaded on the carriage 2*d* with its original side turned up.

Accordingly, when the ribbon cassette 7*d* loaded as above is once removed from the carriage 2*d* and then the ribbon cassette 7*d* is reloaded onto the carriage 2*d*, loading with the original side turned up is allowed because the downwardly protruded end 25*b* of the blocking rod 25 is fitted into the recess 23. On the other hand, if it is attempted to reload the ribbon cassette 7*d* with the reverse side turned up by mistake, the upwardly protruding end 25*a* then comes in abutment with the upper surface of the carriage 2*d* since the protruding end 25*a* of the blocking rod 25 is positioned leftward of the center of the carriage 2*d* when the ribbon cassette 7*d* is turned over. Thus reloading of the ribbon cassette 7*d* is prevented unless the blocking rod 25 is shifted to the left-hand section as indicated by double-dotted lines in FIG. 17.

As above described, according to the present invention, if the ribbon cassette 7 is going to be reloaded with the reversed side up after it is removed from the carriage 2, the ribbon cassette 7 is prevented from reloading, while reloading is allowed without any difficulties if the same side as before removal is turned up. Thus, it is certainly acknowledged whether the side turned up for reloading is the same side as before removal or not, and thereby, blurred printing by the use of once used area of the ribbon 8 and/or waste of the ribbon 8 which has not yet completely used can be avoided.

Moreover, according to the present invention, even in case the ribbon cassette 7 is a so-called multi-use type one wherein the same area on the ribbon surface is repeatedly used for printing, the possibility of the printing quality being uneven depending upon the area on the ribbon 8 to be used due to the difference in the number of times of use thereof can also be prevented.

This invention is not restricted to the above described embodiments, but further modifications may be made without departing from the spirit of the invention.

What is claimed is:

1. A printing apparatus having a carriage movable along a platen and a ribbon cassette having a first side and an opposite second side, said cassette being configured to be loaded on a cassette mounting surface of said carriage so that either of its sides may face upward in an invertible manner, said printing apparatus comprising:

a projection vertically protruding from said cassette mounting surface;

indicating means provided on said ribbon cassette and including a blocking member engageable with said projection and capable of being displaced between two different positions in said vertical direction;

whereby said projection and said blocking member cooperate to prevent reloading of said ribbon cassette if the side of said ribbon cassette which is attempted to be directed upward in reloading said ribbon cassette after once removed from said mounting surface is not the same side that faced upward before being removed.

2. The apparatus according to claim 1 wherein said indicating mean comprises a vertically extending through-hole formed in said ribbon cassette defining two holding spaces; in one of which said blocking member is selectively accommodated and said projection is formed on said carriage to be received in one of said holding spaces when said ribbon cassette is loaded.

3. The apparatus according to claim 1 wherein said blocking member is rotatably mounted on said ribbon cassette and is selectively held at one of two predetermined positions on the rotary locus thereof, and said projection is formed on said carriage to be crossed with said rotary locus of said blocking member when said ribbon cassette is loaded.

4. The apparatus according to claim 1 wherein said indicating means comprises a pair of recesses symmetrically formed on both sides of said ribbon cassette, said blocking member is selectively accommodated in one of said recesses, and said projection is formed on said carriage to be received in one of said recesses when said ribbon cassette is loaded.

5. A printing apparatus wherein an invertible ribbon cassette is detachably installed on a cassette mounting surface of a carriage, which comprises:

a through-hole formed on said ribbon cassette and provided with a pair of engaging portions on the inner surface thereof at a predetermined vertical interval; and a blocking member configured to be slidably received in said through-hole and provided with one specific portion at the vertically intermediate position thereof to be selectively engaged with one of said engaging portions, one selected end of said blocking member protruding out of one selected side surface of said ribbon cassette if said specific portion of said blocking member is engaged with a selected one of said engaging portions, whereby said cassette mounting surface and said blocking member may prevent reloading of said ribbon cassette if the upward side of said ribbon cassette attempted to be reloaded after being once removed is not the same side that faced upward before being removed.

6. A printing apparatus wherein an invertible ribbon cassette is detachably installed on a carriage, which comprises:

a through-hole formed on said ribbon cassette and horizontally defined for two holding spaces;

an engaging member configured to be selectively accommodated in one of said holding spaces and having both ends protruding out of both sides of said ribbon cassette, respectively; and a recess formed in said carriage whereby one of said both ends of said engaging member is received in said recess when said engaging member is accommodated in a selected one of said holding spaces.

* * * * *